US006630066B2

(12) United States Patent
Cash et al.

(10) Patent No.: US 6,630,066 B2
(45) Date of Patent: Oct. 7, 2003

(54) HYDROCRACKING AND HYDROTREATING SEPARATE REFINERY STREAMS

(75) Inventors: Dennis R. Cash, Novato, CA (US); Arthur J. Dahlberg, Benicia, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 262 days.

(21) Appl. No.: 09/808,671

(22) Filed: Mar. 14, 2001

(65) Prior Publication Data

US 2001/0042699 A1 Nov. 22, 2001

Related U.S. Application Data

(63) Continuation-in-part of application No. 09/227,783, filed on Jan. 8, 1999, now Pat. No. 6,224,747.

(51) Int. Cl.[7] ..... C10G 65/12

(52) U.S. Cl. ..... 208/58; 208/97; 208/107; 208/142

(58) Field of Search ..... 208/58, 59, 97, 208/107, 142

(56) References Cited

U.S. PATENT DOCUMENTS 5,009,768 A * 4/1991 Galiasso et al. ..... 208/89
5,013,422 A * 5/1991 Absil et al. ..... 208/27
5,258,117 A * 11/1993 Kolstad et al. ..... 208/309
5,275,719 A * 1/1994 Baker, Jr. et al. ..... 208/58
5,290,427 A * 3/1994 Fletcher et al. ..... 208/89
5,364,514 A * 11/1994 Sanborn et al. ..... 208/58
5,522,983 A * 6/1996 Cash et al. ..... 208/59
6,096,190 A * 8/2000 Cash ..... 209/89
6,123,830 A * 9/2000 Gupta et al. ..... 208/76
6,179,995 B1 * 1/2001 Cash et al. ..... 208/89
6,328,879 B1 * 12/2001 Kalnes ..... 208/78
6,361,683 B1 * 3/2002 Kalnes ..... 208/89
6,379,532 B1 * 4/2002 Hoehn et al. ..... 208/58

FOREIGN PATENT DOCUMENTS

WO WO 97/23584 7/1997 ..... C10G/65/12

OTHER PUBLICATIONS

Frank Ennenbach/Baerbel Kolbe/Uwe Ranke/Krupp Uhde, "Divided–wall columns a novel distillation concept" (Process Technology, Autumn, 2000), pp. 97–103.

* cited by examiner

*Primary Examiner*—Bekir L. Yildirim
(74) *Attorney, Agent, or Firm*—Penny L. Prater

(57) ABSTRACT

This invention is directed to middle distillate production (e.g., diesel and kerosene products) by means of a reactor hydroprocessing system using two or more reactors (or a single reactor vessel having two or more stages, each stage containing one or more reaction zones). Hydrocracking is preferably performed in the initial reactor, and hydrotreating (and/or further hydrocracking) is preferably performed in the subsequent reactor vessel or stages within a single vessel. Reaction stages are effectively segregated to avoid recracking of products, to dramatically reduce hydrogen consumption in saturating the bottoms product and to carry out aromatic saturation of middle distillates in a clean low-temperature environment.

26 Claims, 2 Drawing Sheets

HYDROCRACKING AND HYDROTREATING SEPARATE REFINERY STREAMS

This application is a continuation-in-part of application, Ser. No. 09/227,783, filed Jan. 8, 1999 now U.S. Pat. No. 6,224,747.

FIELD OF THE INVENTION

This invention is directed to middle distillate production (e.g., diesel and kerosene products) by means of a reactor hydroprocessing system using two or more reactors (or a single reactor vessel having two or more stages, each stage containing one or more reaction zones). Product effluents are effectively segregated to avoid recracking of products, to dramatically reduce hydrogen consumption in saturating the bottoms product, and to carry out aromatic saturation of middle distillates in a clean low-temperature environment.

BACKGROUND OF THE INVENTION

In an SSOT (single-stage once-through) environment, all the products of the reaction from each zone of a reactor are forced to pass over following zones in a cascade mode. Operating conditions of the reactor are dictated by the need for deep denitrification and subsequent conversion in a harsh ammonia and hydrogen sulfide-rich environment. Temperatures tend to be higher, favoring hydrocracking, and are not optimal for aromatic saturation. Recracking occurs in the lower beds, leading to destruction of valuable diesel and jet range material to naphtha and lighter material. Since there is no subsequent reactor stage available, all products must be hydrogenated in the same reactor system. The biggest source of hydrogen loss is the oversaturation of the unconverted oil destined for the FCC unit.

The parent application was concerned with a single stage process (employing more than one reaction zone, preferably in a single reactor vessel) for hydroconverting dissimilar refinery streams using a single hydrogen source. It disclosed a method for hydroprocessing two refinery streams using a single hydrogen supply and a single hydrogen recovery system. It further disclosed a method for hydrocracking a refinery stream and hydrotreating a second refinery stream in a common reactor and with a common hydrogen feed supply in which the feed to the hydrocracking zone was not poisoned with contaminants present in the feed to the hydrotreating reaction zone. Furthermore, the parent application was directed to hydroprocessing two or more dissimilar refinery streams in an integrated hydroconversion process while maintaining good catalyst life and high yields of the desired products, particularly distillate range refinery products. Such dissimilar refinery streams might originate from different refinery processes, such as a VGO, derived from the effluent of a VGO hydrotreater, which contains relatively few catalyst contaminants and/or aromatics, and an FCC cycle oil or straight run diesel, which contains substantial amounts of aromatic compounds.

Publications concerned with methods for using a single hydrogen loop in a two-stage reaction process have been disclosed in the parent application. The instant invention is further concerned with effectively segregating reaction stages in order to avoid recracking of products. Segregation may be done using two separate fractionation columns or a single fractionation column in which reaction stages are separated by the use of a baffle. The article, "Divided-wall columns novel distillation concept" (*Process Technology*, Autumn, 2000), discloses the use of divided wall columns in benzene removal processes.

WO 97/23584 discloses an integrated hydroprocessing scheme involving a hydrocracking stage and a subsequent dewaxing stage for the production of lubricants, as well as naphtha and middle distillates. (The instant invention is directed to hydrocracking and hydrotreating of middle distillates). The bottoms streams, and optionally other streams from each stage, are maintained separately from one another during processing. Dewaxing may occur using either hydroisomerization catalysts, shape-selective catalysts, or both in series. One embodiment employs a baffle in the flash zone of a fractionator to separate bottoms streams from each other. Alternately, the effluent from the hydrocracking stage may be processed separately from the effluent from the dewaxing stage. The bottoms fraction from the dewaxing stage may be recycled back to the hydrocracking stage for further processing or used as a lube base stock.

SUMMARY OF THE INVENTION

This invention is directed to middle distillate production (e.g., diesel and kerosene products) by means of a reactor hydroprocessing system using two or more reactors (or a single reactor vessel having two or more stages, each stage containing one or more reaction zones). Hydrocracking is preferably performed in the initial reactor, and hydrotreating (and/or further hydrocracking) is preferably performed in a subsequent reactor or reactors. Reaction effluents are effectively segregated to avoid recracking of products, in order to dramatically reduce hydrogen consumption in saturating the bottoms product and to carry out aromatic saturation of middle distillates in a clean low-temperature environment.

The quality of the products from the different reactors (or stages) can be distinctly different, and this invention keeps them segregated for specialized use or marketing. The preferred means of separation is by using separate fractionators or distillation columns, although, in an alternate configuration, a single fractionator having a baffle may be used. The latter configuration results in decreased modification expense.

In the instant invention, when hydrotreating is desired, feed may be hydrotreated at relatively high space velocities and low hydrogen-to-oil ratio. Conditions will be suitable for deep hydrodesulfurization, hydrodenitrification and low conversion. Intermediate flash zones and rough fractionation segregates the lighter product effluent from the first reactor from the bottoms.

FCC feed essentially consists of unconverted oil from the first reactor. The remainder of the unconverted oil is extinction cracked to diesel in a clean second stage reactor operating under typical second stage hydrocracking conditions. The last bed of the second stage reactor is used to "post-treat" the small quantity of distillates formed in the first stage.

The operating conditions in the second reactor (or stage) of a two-reactor (or two-stage) hydroprocessing system (moderate temperature, high partial pressure hydrogen, low partial pressure nitrogen, and low partial pressure $H_2S$) are very favorable for aromatic saturation. Therefore, injection of middle distillates or other stocks needing saturation into the bottom beds and processing over treating catalyst (the second-stage cracking catalyst being upstream or mostly upstream of the point of injection) provides a low cost means to upgrade these stocks. The injected stocks might be straight run kerosene or diesel, cracked stocks such as coker gas oils or FCC cycle oils, or could even be first stage middle distillates in cases where first stage conditions hinder the attainment of what are sometimes very stringent product specifications (e.g., smoke point, cetane number). This scheme can also be used for very deep hydrodesulfurization.

DETAILED DESCRIPTION OF THE INVENTION

Feeds

Figure 1:
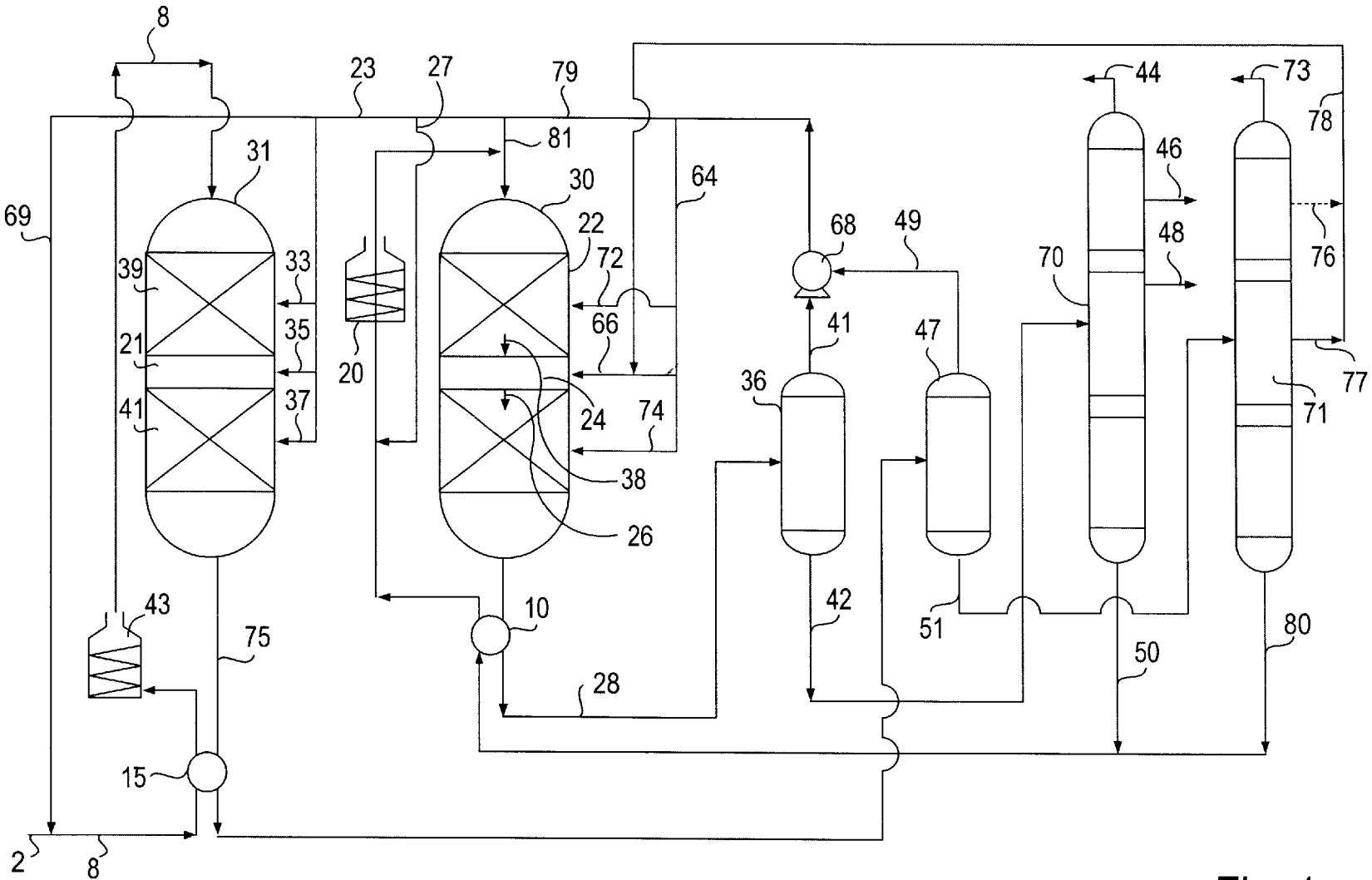
FIG. 1 illustrates a preferred embodiment of the instant invention. Two reactor vessels, each vessel having more than one reaction zone. The effluent from the reactors are maintained separately from each other. Separate flash drums and fractionators are employed.

One suitable feed to the first reactor is a VGO having a boiling point range starting at a temperature above 500° F. (260° C.), usually within the temperature range of 500–100° F. (260–593° C.). A refinery stream wherein 75 vol. % of the refinery stream boils within the temperature range 650–1050° F. is an example feedstock for the feed to the first reactor. The first refinery stream may contain nitrogen, usually present as organonitrogen compounds, in amounts greater than 1 ppm. Preferred feed streams to the first reactor contain less than about 200 ppm nitrogen and less than 0.25 wt. % sulfur, though feeds with higher levels of nitrogen and sulfur, including those containing up to 0.5 wt. % and higher nitrogen and up to 2 wt. % sulfur and higher may be treated in the present process. The first refinery stream is also preferably a low aromatic stream, including multi-ring aromatics and asphaltenes. Suitable first refinery streams contain less than about 500 ppm asphaltenes, preferably less than about 200 ppm asphaltenes, and more preferably less than about 100 ppm asphaltenes. Example streams include light gas oil, heavy gas oil, straight run gas oil, deasphalted oil, and the like. The first refinery stream may have been processed, e.g., by hydrotreating, prior to the present process to reduce or substantially eliminate its heteroatom content. The first refinery stream may comprise recycle components.

The first reaction step removes nitrogen and sulfur from the first refinery stream in the first reaction zone and effects a boiling range conversion, so that the liquid portion of the first reaction zone effluent has a normal boiling range below the normal boiling point range of the first refinery feedstock. By "normal" is meant a boiling point or boiling range based on a distillation at one atmosphere pressure. Unless otherwise specified, all distillation temperatures listed herein refer to normal boiling point and normal boiling range temperatures. The process in the first reaction zone may be controlled to a certain cracking conversion or to a desired product sulfur level or nitrogen level or both. Conversion is generally related to a reference temperature, such as, for example, the minimum boiling point temperature of the hydrocracker feedstock. The extent of conversion relates to the percentage of feed boiling above the reference temperature which is converted to products boiling below the reference temperature.

The effluent from the first reactor vessel, which has been processed over one or more zones containing a hydroprocessing catalyst or catalysts, includes normally liquid phase components, e.g., reaction products and unreacted components of the first refinery stream, and normally gaseous phase components, e.g., gaseous reaction products and unreacted hydrogen. In the process, the first reactor is maintained at conditions sufficient to effect a boiling range conversion of the first refinery stream of at least about 25%, based on a 650° F. reference temperature. Thus, at least 25% by volume of the components in the first refinery stream which boil above about 650° F. are converted in the first reactor to components which boil below about 650° F. Operating at conversion levels as high as 100% is also within the scope of the invention. Example boiling range conversions are in the range of from about 30% to 90% or of from about 40% to 80%. The first reactor effluent is further decreased in nitrogen and sulfur content, with at least about 50% of the nitrogen containing molecules in the first refinery stream being converted in the first reactor. Preferably, the normally liquid products present in the first reactor effluent contain less than about 1000 ppm sulfur and less than about 200 ppm nitrogen, more preferably less than about 250 ppm sulfur and about 100 ppm nitrogen.

Examples of streams to the second reactor which are suitable for treating in the present process include straight run vacuum gas oils, including straight run diesel fractions, from crude distillation, atmospheric tower bottoms, or synthetic cracked materials such as coker gas oil, light cycle oil or heavy cycle oil.

The feed to the second reactor has a boiling point range generally lower than the first refinery stream. A substantial portion of the second refinery stream has a normal boiling point in the middle distillate range, so that cracking to achieve boiling point reduction is not necessary. Thus, at least about 75 vol. % of a suitable feed to the second reactor has a normal boiling point temperature of less than about 1000° F. A refinery stream with at least about 75% v/v of its components having a normal boiling point temperature within the range of 250° F.–700° F. in an example of a preferred stream to the second reactor. A refinery stream with at least about 75 vol. % of its components having a normal boiling point temperature within the range of 250° F.–700° F. is another example of a preferred stream to a second reactor. The process is particularly suited for treating middle distillate streams which are not suitable for high quality fuels. For example, the process is suitable for treating a stream to the second reactor which contains high amounts of nitrogen and/or high amounts of aromatics, including streams which contain up to 90% aromatics and higher.

Catalysts

Each of the reactor vessels may contain one or more catalysts. If more than one distinct catalyst is present in either of the reactors, the catalysts may be blended or be present as distinct layers, creating multiple reaction zones. Layered catalyst systems are taught, for example, in U.S. Pat. No. 4,990,243, the disclosure of which is incorporated herein by reference for all purposes. Hydrocracking catalysts useful for the first reaction zone are well known. In general, the hydrocracking catalyst comprises a cracking component and a hydrogenation component on an oxide support material or binder. The cracking component may include an amorphous cracking component and/or a zeolite, such as a Y-type zeolite, an ultrastable Y type zeolite, or a dealuminated zeolite. A suitable amorphous cracking component is silica-alumina.

The hydrogenation component of the catalyst particles is selected from those elements known to provide catalytic hydrogenation activity. At least one metal component selected from the Group VIII elements and/or from the Group VI elements is generally chosen. Group V elements include chromium, molybdenum and tungsten. Group VIII elements include iron, cobalt, nickel, ruthenium, rhodium, palladium, osmium, iridium and platinum. The amount(s) of hydrogenation component(s) in the catalyst suitably range from about 0.5% to about 10% by weight of Group VIII metal component(s) and from about 5% to about 25% by weight of Group VI metal component(s), calculated as metal oxide(s) per 100 parts by weight of total catalyst, where the percentages by weight are based on the weight of the catalyst before sulfiding. The hydrogenation components in the catalyst may be in the oxidic and/or the sulphidic form. If a combination of at least a Group VI and a Group VIII metal component is present as (mixed) oxides, it will be subjected to a sulfiding treatment prior to proper use in hydrocracking. Suitably, the catalyst comprises one or more components of nickel and/or cobalt and one or more components of molybdenum and/or tungsten or one or more components of platinum and/or palladium. Catalysts containing nickel and molybdenum, nickel and tungsten, platinum and/or palladium are particularly preferred.

The hydrocracking catalyst particles of this invention may be prepared by blending, or co-mulling, active sources of hydrogenation metals with a binder. Examples of suitable binders include silica, alumina, clays, zirconia, titania, magnesia and silica-alumina. Preference is given to the use of alumina as binder. Other components, such as phosphorous, may be added as desired to tailor the treatment prior to proper use in hydrocracking. Suitably, the catalyst comprises one or more components of nickel and/or cobalt and one or more components of molybdenum and/or tungsten or one or more components of platinum and/or palladium. Catalysts containing nickel and molybdenum, nickel and tungsten, platinum and/or palladium are particularly preferred.

The second reactor contains hydrotreating catalyst in at least one zone, which is maintained at hydrotreating conditions. Hydrotreating catalysts are suitable for hydroconversion of feedstocks containing high amounts of sulfur, nitrogen and/or aromatic-containing molecules. It is a feature of the present invention that hydrotreating may be used to treat feedstocks containing asphaltenic contaminants which would otherwise adversely affect the catalytic performance or life of the hydrocracking catalysts. The hydrotreating catalysts are selected for removing these contaminants to low values. Such catalysts generally contain at least one metal component selected from Group VIII and/or at least one metal component selected from the Group VI elements. Group VI elements include chromium, molybdenum and tungsten. Group VIII elements include iron, cobalt and nickel.

While the noble metals, especially palladium and/or platinum, may be included, alone or in combination with other elements, in the hydrotreating catalyst, use of the noble metals as a hydrogenation component is not preferred. The amount(s) of hydrogenation component(s) in the catalyst suitably range from about 0.5% to about 10% by weight of Group VIII metal component(s) and from about 5% to about 25% by weight of Group VI metal component(s), calculated as metal oxide(s) per 100 parts by weight of total catalyst, where the percentages by weight are based on the weight of the catalyst before sulfiding. The hydrogenation components in the catalyst may be in the oxidic and/or the sulphidic form. If a combination of at least a Group VI and a Group VIII metal component is present as (mixed) oxides, it will be subjected to a sulfiding treatment prior to proper use in hydrocracking. Suitably, the catalyst comprises one or more components of nickel and/or cobalt and one or more components of molybdenum and/or tungsten. Catalysts containing cobalt and molybdenum are particularly preferred.

The hydrotreating catalyst particles of this invention are suitably prepared by blending, or co-mulling, active sources of hydrogenation metals with a binder. Examples of suitable binders include silica, alumina, clays, zirconia, titania, magnesia and silica-alumina. Preference is given to the use of alumina as binder. Other components, such as phosphorous, may be added as desired to tailor the catalyst particles for a desired application. The blended components are then shaped, such as by extrusion, dried and calcined at temperatures up to 1200° F. (649° C.) to produce the finished catalyst particles. In the alternative, equally suitable methods of preparing the amorphous catalyst particles include preparing oxide binder particles, such as by extrusion, drying and calcining, followed by depositing the hydrogenation metals on the oxide particles using methods such as impregnation. The catalyst particles, containing the hydrogenation metals, are then further dried and calcined prior to use as a hydrotreating catalyst.

Operating Conditions

Reaction conditions in the first reactor include a reaction temperature between about 250° C. and about 500° C. (482° F.–932° F.), pressures from about 3.5 MPa to about 24.2 MPa (500–3,500 psi), and a feed rate (vol oil/vol cat h) from about 0.1 to about 20 $hr^{-1}$. Hydrogen circulation rates are generally in the range from about 350 std liters $H_2$/kg oil to 1780 std liters $H_2$/kg oil (2,310–11,750 standard cubic feet per barrel). Preferred reaction temperatures range from about 340° C. to about 455° C. (644° F.–851° F.). Preferred total reaction pressures range from about 7.0 MPa to about 20.7 MPa (1,000–3,000 psi). With the preferred catalyst system, it has been found that preferred process conditions include contacting a petroleum feedstock with hydrogen under hydrocracking conditions comprising a pressure of about 13.8 MPa to about 20.7 MPa (2,000–3000 psi), a gas to oil ratio between about 379–909 std liters $H_2$/kg oil (2,500–6,000 scf/bbl), a LHSV of between about 0.5–1.5 $hr^{-1}$, and a temperature in the range of 360° C. to 427° C. (680° F.–800° F.).

The second reactor contains at least one zone which is maintained at conditions sufficient to remove at least a portion of the nitrogen compounds and at least a portion of the aromatic compounds from the feed to the second reactor. In the preferred embodiment, there are at least two reaction zones which are in liquid and vapor communication with each other. The pressure and the temperature in the second reaction zone are substantially the same as the pressure and the temperature in the first reaction zone. A small pressure decrease may occur, depending on the pressure drop across the reaction zones and through the interstage region. The second reaction zone will operate at approximately the same temperature as the first reaction zone, except for possible temperature gradients resulting from exothermic heating within the reaction zones, moderated by the addition of relatively cooler streams into the one or more reaction zones or into the interstage region. Feed rate of the reactant liquid stream through the reaction zones will be in the region of 0.1 to 20 $hr^{-1}$ liquid hourly space velocity. Feed rate through second reaction zone will be increased relative to the feed rate through first reaction zone by the amount of liquid feed in second refinery stream and will also be in the region of 0.1 to 20 $hr^{-1}$ liquid hourly space velocity. These process conditions selected for the first reaction zone may be considered to be more severe than those conditions normally selected for a hydrotreating process.

Hydroprocessing conditions in the second reactor may provide either hydrotreating or further hydrocracking depending on the feed and the desired characteristics of the effluent. If hydrocracking is occurring, the reaction temperature is typically between about 250° C. and about 500° C. (482° F.–932° F.), pressures from about 3.5 MPa to about 24.2 MPa (500–3,500 psi), and a feed rate (vol oil/vol cat h) from about 0.1 to about 20 $hr^{-1}$. Hydrogen circulation rates are generally in the range from about 350 std liters $H_2$/kg oil to 1780 std liters $H_2$/kg oil (2,310–11,750 standard cubic feet per barrel). Preferred reaction temperatures range from about 340° C. to about 455° C. (644° F.–851° F.). Preferred total reaction pressures range from about 7.0 MPa to about 20.7 MPa (1,000–3,000 psi). U.S. Pat. No. 4,435,275 further describes the conditions employed in a process for producing low sulfur distillates by operating the hydrotreating-hydrocracking process without interstage separation and at relatively low pressures, typically below about 7,000 kPa (about 1,000 psig).

The process of the instant invention is especially useful in the production of middle distillate fractions boiling in the range of about 250° F.–700° F. (121° C.–371° C.). By a middle distillate fraction having a boiling range of about 250° F.–700° F. is meant that at least 75 vol. %, preferably 85 vol. %, of the components of the middle distillate have a normal boiling point of greater than about 250° F. and furthermore that at least about 75 vol. %, preferably 85 vol. %, of the components of the middle distillate have a normal boiling point of less than 700° F. The term "middle distillate" is intended to include the diesel, jet fuel and kerosene boiling range fractions. The kerosene or jet fuel boiling point range is intended to refer to a temperature range of about 280° F.–525° F. (138° C.–274° C.), and the term "diesel boiling range" is intended to refer to hydrocarbon boiling points of about 250° F.–700° F. (121° C.–371° C.). Gasoline or naphtha is normally the $C_5$ to 400° F. (204° C.) endpoint fraction of available hydrocarbons. The boiling point ranges of the various product fractions recovered in any particular refinery will vary with such factors as the characteristics of the crude oil source, refinery local markets, product prices, etc.

DESCRIPTION OF THE PREFERRED EMBODIMENT

Figure 2:
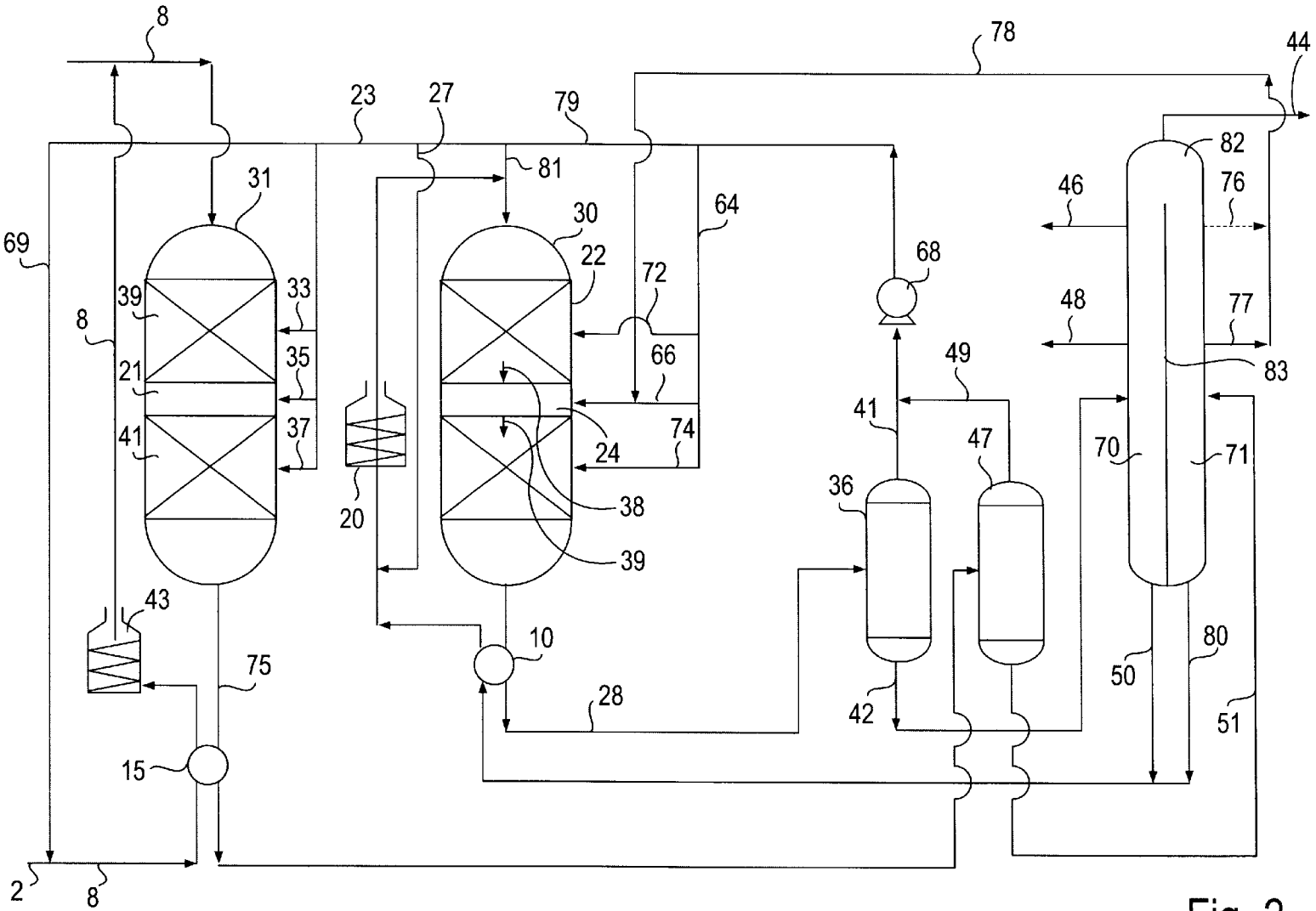
FIG. 2 illustrates another embodiment of the invention, whereby reactor effluents are separated by the use of a single fractionator having a baffle, rather than two fractionators.

Reference is now made to FIGS. 1 and 2, which disclose preferred embodiments of the invention. Not included in the figures are the various pieces of auxiliary equipment such as heat exchangers, condensers, pumps and compressors, which, of course, would be necessary for a complete processing scheme and which would be known and used by those skilled in the art.

FIG. 1 illustrates two downflow reactor vessels 30 and 31, each containing at least two vertically aligned reaction zones. The first reaction zone 39, found in reactor vessel 31, is for cracking a first refinery stream 8. The second reaction zone 41 of reactor vessel 31 is an additional hydroprocessing zone 41 for additional upgrading. The severity of the upgrading will depend upon the characteristics desired of the reactor effluent.

The first reaction zone 22 of reactor vessel 30 is for cracking a second refinery stream 79. The second reaction zone 26 is for removing nitrogen-containing and aromatic molecules from a second refinery stream 78.

In either of the reactor vessels 30 and 31, suitable volumetric ratio of the catalyst volume in the first reaction zone to the catalyst volume in the second reaction zone encompasses a broad range, depending on the ratio of the first refinery stream to the second refinery stream. Typical ratios generally lie between 20:1 and 1:20. A preferred volumetric range is between 10:1 and 1:10. A more preferred volumetric ratio is between 5:1 and 1:2.

In integrated process, a first refinery stream 2 is combined with a hydrogen-rich gaseous stream 69 to form a first feedstock 8, passed to first reaction zone 39 contained within reactor vessel 31. Hydrogen-rich gaseous stream 69 contains greater than 50% hydrogen, the remainder being varying amounts of light gases, including hydrocarbon gases. The hydrogen-rich gaseous stream 69 shown in the drawing is primarily recycle hydrogen. While the use of a recycle hydrogen stream is generally preferred for economic reasons, it is not required. First feedstock 8 may be heated in one or more exchangers, such as exchanger 15, and one or more heaters, such as heater 43, before being introduced to first reaction zone 39.

Interstage region 21 is a region in the reactor vessel which contains means for mixing and redistributing liquids and gases from the reaction zone above before they are introduced into the reaction zone below. Such mixing and redistribution improves reaction efficiency and reduces the chances of thermal gradients or hot spots in the reaction zone below. Additional streams, including an additional hydrogen stream 35, may also be introduced into the reactor vessel in the interstage region. Hydrogen may also be added as a quench stream through lines 33 and 37 for cooling the first and the second reaction zones, respectively. Streams 33, 35 and 37 are branches of stream 23.

The effluent of reactor 31 exits the reaction zone 41 through line 75 and is cooled in exchanger 15. The effluent 75 proceeds to separation zone 47. Separation zone 47 represents one or more process units known in the art for separating normally liquid products from normally gaseous products in the reaction effluent 75, and thus preparing a liquid stream 51 and a purified hydrogen stream 49. An example separation scheme for a hydroconversion process is taught in U.S. Pat. No. 5,082,551, the entire disclosure of which is incorporated herein by reference for all purposes. In the example embodiment of FIG. 1, effluent 75 is separated in separation zone 47 to form second hydrogen-rich gaseous stream 49 and liquid stream 51. Separation zone 47 may include means for contacting a gaseous component of the reaction effluent 75 with a solution, such as an alkaline aqueous solution, for removing contaminants such as hydrogen sulfide and ammonia which may be generated in the reaction zones and may be present in reaction effluent 75. The second hydrogen-rich gaseous stream is preferably recovered from the separation zone at a temperature in the range of 100° F.–300° F., or 100° F.–200° F. Purified hydrogen stream 49, the second hydrogen-rich gaseous stream recovered from separation zone 47, is recompressed, along with hydrogen from separation zone 36, through compressor 68 and passed as recycle to one or both of the reactors (see streams 33, 35 and 36, or 72, 66 and 74) and as a quench stream for cooling the reaction zones. Such uses of hydrogen are well known in the art.

Liquid stream 51 is further separated in distillation zone 71 to produce overhead stream 73, distillate fractions 76 and 77, and bottoms product 80. A preferred distillate product has a boiling point range within the temperature range 250° F.–700° F. A gasoline or naphtha fraction having a boiling point range within the temperature range $C_5$–400° F. is also desirable. At least a portion of one or more distillate fractions or bottoms fractions recovered from distillation zone 71 may be recycled to the first reaction vessel. Recycle of stream 80 is preferred.

Stream 80 may be combined with stream 50, the effluent from fractionator 70, and heated in exchanger 10. Stream 80 is combined with hydrogen rich gas stream 27, further heated in heater 20, and combined with hydrogen-rich gas stream 79 to form a second feedstock 81, passed to first reaction zone 22 contained within reactor vessel 30. Hydrogen-rich gaseous stream 27 contains greater than 50% hydrogen, the remainder being varying amounts of light gases, including hydrocarbon gases. The hydrogen-rich gaseous stream 27 shown in the drawing is primarily recycle hydrogen. In the process, distillate stream 78 is combined with optional hydrogen stream 64 forming combined feedstock 66, and is further combined with the total first reaction zone effluent 38 from the first reaction zone 22 to form second feedstock 39 for passage through the second reaction zone. In the embodiment shown in the drawing in FIG. 1, the combination of the two streams takes place in interstage region 24. Optional hydrogen stream 64 is shown originating as a portion of recycle hydrogen stream 79. Alternatively, optional hydrogen stream 64 may be a fresh hydrogen stream, originating from hydrogen sources external to the present process.

The second feedstock 39, comprising combined stream 66 and first reaction zone effluent 38, is passed to a second reaction zone 26. The second reaction zone 26 contains at least one bed of catalyst, such as hydrotreating catalyst, which is maintained at conditions sufficient for converting at least a portion of the nitrogen compounds and at least a portion of the aromatic compounds in the second feedstock.

Effluent from reactor 30, stream 28, may be cooled in heat exchanger 10. Stream 28 is further separated into at least one distillate fraction and a second hydrogen-rich gaseous stream 41 in separation zone 36, preparing a liquid stream 42 and a purified hydrogen stream 41. Hydrogen-rich stream 41 is preferably recovered from the separation zone at a temperature in the range of 100° F.–300° F., or 100° F.–200° F. Stream 41 is recompressed through compressor 68 and passed as recycle to one or more of the reaction zones and as a quench stream (streams 72, 66 and 74) for cooling the reaction zones. Such uses of hydrogen are well known in the art.

Liquid stream 42 is further separated in distillation zone 70 to produce overhead stream 44, distillate fractions 46 and 48, and bottoms product 50. A preferred distillate product has a boiling point range within the temperature range 250° F.–700° F. A gasoline or naphtha fraction having a boiling point range within the temperature range $C_5$–400° F. is also desirable. At least a portion of one or more distillate fractions or bottoms fractions recovered from distillation zone 70 may be recycled to the second reactor 30. Recycle of bottoms fraction 70 is preferred.

It is a feature of the present invention that the effluents of the first reaction vessel 31 and the second reactor vessel 30 are maintained separately. None of stream 80 is recycled to the first reaction vessel 31, in order to prevent overcracking of the second refinery stream components. Accordingly, all of the converted second refinery stream present in the effluent of reactor 30 is recovered as a distillate fraction for use elsewhere, most being recovered as either a light gas, naphtha or middle distillate fuel.

FIG. 2 illustrates a flow scheme identical to FIG. 1, except that separate fractionators 70 and 71 are replaced by a single fractionator 82 having a baffle 83. The fractionator is divided by the baffle into sections 70 and 71 which are comparable to fractionators 70 and 71 in FIG. 1.

What is claimed is:

1. An integrated hydroconversion process employing at least two reactors, each reactor possessing one or more reaction zones within it, in which the effluent stream from each reactor is maintained separately, the process comprising:

(a) combining a first refinery stream with a first hydrogen-rich gaseous stream to form a first feedstock;

(b) passing the first feedstock to a first reactor having one or more reaction zones, at least one of which is maintained at conditions sufficient to effect a boiling range conversion, to form a first reactor effluent comprising normally liquid phase components and normally gaseous phase components;

(c) passing the entire effluent of step (b) to a separation zone, where it is separated into at least one distillate fraction and a second hydrogen-rich gaseous stream;

(d) recycling at least a portion of the second hydrogen-rich gaseous stream to either one or both of the reactors;

(e) passing the distillate fraction of step (d) to a fractionator, where it is separated into at least one middle distillate stream and a bottoms product;

(f) passing the bottoms product of step (e) to a second reactor having a first reaction zone which is maintained at conditions sufficient to effect a boiling range conversion, to form a first reaction zone effluent comprising normally liquid phase components and normally gaseous phase components;

(g) combining the entire first reaction zone effluent of the second reactor with a second refinery stream which comprises at least a portion of the middle distillate stream of step (f), the second refinery stream having a boiling point range below the boiling point range of the first refinery stream, to form a second feedstock;

(h) passing the second feedstock to a second reaction zone maintained at conditions sufficient for converting at least a portion of the aromatics present in the second refinery stream, to form a second reaction zone effluent;

(i) passing the entire effluent of step (h) to a separation zone, where it is separated into at least one distillate fraction and a second hydrogen-rich gaseous stream;

(j) recycling at least a portion of the second hydrogen-rich gaseous stream to either one or both of the reactors;

(k) passing the distillate fraction of step (j) to a fractionator, where it is separated into at least one middle distillate stream and a bottoms product; and (l) recycling at least a portion of the bottoms product of step (k) to step (g).

2. The process according to claim 1 wherein the first reactor is maintained at conditions sufficient to effect a boiling range conversion of the first refinery stream of at least about 25%.

3. The process according to claim 2 wherein the first reactor is maintained at conditions sufficient to effect a boiling range conversion of between 30% and 90%.

4. The process according to claim 1 wherein the first refinery stream has a normal boiling point range within the temperature range 500° F.–1100° F. (262° C.–593° C.).

5. The process according to claim 1 wherein the first refinery stream is derived from a hydrotreating process.

6. The process according to claim 1 wherein the first refinery stream is a VGO.

7. The process according to claim 1 wherein at least about 80% by volume of the second refinery stream boils at a temperature of less than about 1000° F.

8. The process according to claim 7 wherein at least about 50% by volume of the second refinery stream has a normal boiling point within the middle distillate range.

9. The process according to claim 8 wherein at least about 80% by volume of the second refinery stream boils with the temperature range of 250° F.–700° F.

10. The process of claim 1 wherein steps (c) and (i) take place in different separators.

11. The process of claim 1 wherein steps (e) and (k) take place in different fractionators.

12. The process of claim 1 wherein steps (e) and (k) take place in different sections of the same fractionator, the sections separated by a vertical baffle.

13. The process according to claim 1 wherein the second refinery stream is selected from the group consisting of straight run VGO, light cycle oil, heavy cycle oil and coker gas oil.

14. The process according to claim 1 wherein the second refinery stream has an aromatics content of greater than about 50%.

15. The process according to claim 14 wherein the second refinery stream has an aromatics content of greater than about 70%.

16. The process according to claim 1 wherein the first reaction zone of the first reactor is maintained at hydrocracking reaction conditions, including a reaction temperature in the range of from about 340° C. to about 455° C. (644° F.–851° F.), a reaction pressure in the range of about 3.5–24.2 MPa (500–3500 pounds per square inch), a feed rate (vol oil/vol cat h) from about 0.1 to about 10 $hr^{-1}$, and a hydrogen circulation rate ranging from about 350 std liters $H_2$/kg oil to 1780 std liters $H_2$/kg oil (2,310–11,750 standard cubic feet per barrel).

17. The process according to claim 16 wherein the entire first reaction zone effluent is passed to the second reaction zone at substantially the same temperature and at substantially the same pressure as the first reaction zone.

18. The process according to claim 17 wherein the second reaction zone is maintained at a temperature and at a pressure which are substantially the same as the temperature and the pressure maintained in the first reaction zone.

19. The process according to claim 1 wherein the second reaction zone effluent is separated in a separation zone to form at least a second hydrogen-rich gaseous stream and a liquid stream.

20. The process according to claim 19 wherein the second hydrogen-rich gaseous stream is recovered from the separation zone at a temperature in the range of 100° F.–300° F.

21. The process according to claim 19 wherein the liquid stream is fractionated to form at least one middle distillate stream and a bottoms product.

22. The process according to claim 21 for producing at least one middle distillate stream having a boiling range within the temperature range 250° F.–700° F.

23. The process according to claim 1 for producing a diesel fuel.

24. The process according to claim 1 for producing a jet fuel.

25. The process according to claim 1 wherein the distillate fraction recovered from the hydrotreater reaction zone effluent further comprises components boiling in the range $C_5$–400° F.

26. The process according to claim 1 wherein the effluent of step (b) is passed without interstage separation to a second reaction zone within the reactor for additional upgrading.

* * * * *